United States Patent [19]

Myers

[11] Patent Number: 4,497,526

[45] Date of Patent: Feb. 5, 1985

[54] CIRCUIT BOARD HOUSING HAVING SELF-CONTAINED MODULAR JACK

[75] Inventor: Ronald W. Myers, Landisburg, Pa.

[73] Assignee: AMP Incorporated, Harrisburg, Pa.

[21] Appl. No.: 479,248

[22] Filed: Mar. 28, 1983

[51] Int. Cl.[3] ..... H01R 23/72

[52] U.S. Cl. ..... 339/17 LC; 339/125 R; 339/176 M; 339/210 M

[58] Field of Search ..... 339/17 L, 17 LC, 125 R, 339/126 R, 210 R, 210 M, 91 R, 176 M, 176 MP

[56] References Cited

U.S. PATENT DOCUMENTS

| | | | |
|---|---|---|---|
| 3,850,497 | 11/1974 | Krumreich et al. | 339/126 R |
| 4,071,696 | 1/1978 | Anderson | 179/1 PC |
| 4,202,593 | 5/1980 | Abernethy et al. | 339/125 R |
| 4,210,376 | 7/1980 | Hughes et al. | 339/17 LC |
| 4,221,458 | 9/1980 | Hughes et al. | 339/126 R |
| 4,296,991 | 10/1981 | Hughes et al. | 339/176 MP |
| 4,332,433 | 6/1982 | Balde et al. | 339/125 R |
| 4,392,701 | 7/1983 | Weidler | 339/17 R |

*Primary Examiner*—John McQuade
*Assistant Examiner*—Thomas M. Kline
*Attorney, Agent, or Firm*—F. W. Raring

[57] ABSTRACT

Circuit board housing comprises spaced-apart panels with the circuit board being between the panels. A modular jack is mounted on one surface of the circuit board and the panels have laterally extending flanges which form a wall of the circuit board housing. One of the flanges is provided with an opening which is in alignment with the opening in the modular jack. The modular jack has a clearance notch extending into one of its sidewalls and the circuit board has a similar notch in registry with the clearance notch, these notches providing clearance for an inserted modular plug. The latching shoulder for the modular jack is provided on one of the flanges rather than in the jack housing. These features, the latching shoulder on the flange and the clearance notches, permit a reduction in the thickness of the circuit board housing as measured between the panels.

7 Claims, 5 Drawing Figures

CIRCUIT BOARD HOUSING HAVING SELF-CONTAINED MODULAR JACK

FIELD OF THE INVENTION

This invention relates to modular jack connector receptacles and to the combination of a circuit board housing having a circuit board therein and a self-contained modular jack, the circuit board housing being of reduced dimensions.

BACKGROUND OF THE INVENTION

U.S. Pat. No. 4,210,376 discloses a known type of modular jack connector receptacle which is intended for mounting on a circuit board and which has conductors in the jack housing that are connected to conductors on the circuit board. Frequently, modular jacks of the type shown in U.S. Pat. No. 4,210,376 are used with circuit boards which in turn are contained within a housing that contains the circuit board and possibly additional electrical equipment. Many types of telephone equipment, for example, comprise circuit board housings having self-contained modular jacks with the plug receiving openings of the jack extending inwardly from one of the external walls of the housing.

Ordinarily, modular jacks of the type shown in the aboveidentified U.S. Pat. No. 4,210,376 can be used in such circuit board housings but under some circumstances, the circuit board housing must be relatively thin as measured between parallel panels and the dimensions of the modular jack may be such that the dimensional limitations for the circuit board housing cannot be satisfied. In other words, the modular jack requires a certain amount of space in the circuit board housing and the circuit board housing must be of unacceptable dimensions for some circumstances of use because of the limitations imposed by the modular jack.

The present invention is directed to the achievement of an improved modular jack which permits a substantial reduction in the thickness of a circuit board housing with which the modular jack is used. The invention is further directed to the achievement of the combination of a modular jack receptacle mounted on one surface of a circuit board which is contained in a circuit board housing of reduced dimensions.

A preferred embodiment of the invention comprises the combination of a modular jack receptacle mounted on one surface of a circuit board and a first panel which extends parallel to, and is spaced from, the other surface of the circuit board. The modular jack receptacle comprises an insulating housing having a mating end and a rearward end, a plug receiving opening extending into the mating end, the opening having opposed internal endwalls and first and second opening sidewalls. The housing also has oppositely facing external endwalls and first and second external sidewalls which are proximate to the first and second opening sidewalls. A plurality of conductors are contained in the housing in side-by-side relationship, each conductor having a contact portion which extends from the first opening sidewall diagonally into the opening from a location adjacent to the mating end. Each conductor also has a lead portion which extends to the rearward end of the housing and to the one surface of the circuit board. The second housing sidewall has a latching shoulder thereon facing inwardly of the opening for cooperation with a complementary latching shoulder on a modular plug. The combination of the modular jack receptacle, the circuit board, and the panel is characterized in that the circuit board has one edge which extends parallel to one edge of the first panel and the first panel has a lip extending from the one edge thereof towards the one edge of the circuit board. The lip has an internal surface which is parallel to, and adjacent to, the one edge of the circuit board. The modular jack is mounted on the circuit board adjacent to the one edge thereof and is oriented with the mating end extending normally of the plane of the circuit board and parallel to the lip of the first panel. The lip has a recess therein which is centrally located with respect to the plug-receiving opening, the lip constituting at least portions of the mating end of the modular jack. The latching shoulder of the modular jack is on the internal surface of the lip and in alignment with the recess in the lip.

In accordance with a further embodiment, the circuit board has a circuit board notch extending inwardly from the one edge thereof which is in alignment with the recess in the lip. The modular jack has a clearance notch therein extending inwardly from the mating end, the clearance notch being in registry with the circuit board notch thereby to provide clearance for a modular plug upon insertion of the plug into the plug-receiving opening.

In accordance with a further embodiment, a second panel extends parallel to the first panel, the second panel having an internal surface which is against the first external sidewall of the modular jack, the second panel having a flange extending towards the lip of the first panel, the flange having an opening therein and the mating end of the modular jack is in the opening.

Figure 1:
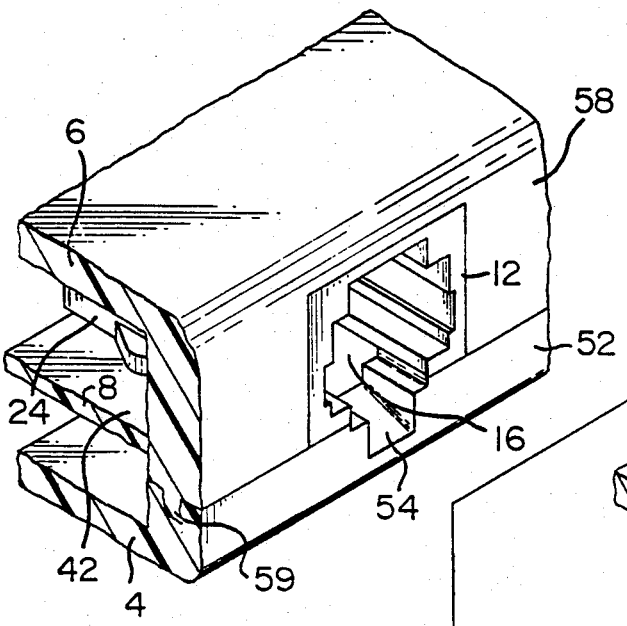
FIG. 1 is a perspective view of a circuit board housing in accordance with the invention showing the wall of the housing in which a modular jack is mounted.

A circuit board housing 2 in accordance with the invention comprises first and second parallel panels 4, 6 respectively which enclose the circuit board 8. The circuit board has a modular jack in accordance with the invention 10 mounted thereon adjacent to one edge 48 of the circuit board.

The modular jack may be of the general type disclosed in the above-identified U.S. Pat. No. 4,210,376 and differs from the jack shown in the patent as will be described below. In general, the modular jack 10 comprises a molded jack housing having a mating end 12, a rearward end 14, and a plug-receiving opening 16 which extends into the mating end. The opening has opposed endwalls 18 and first and second opening sidewalls 20, 22, the first sidewalls being the upper sidewall as viewed in the drawing. The housing has oppositely directed external endwalls 24 and first and second external sidewalls 26, 28 which are proximate to the first and second opening sidewalls.

Mounting extensions 30 extend from the second external sidewall 28 and are dimensioned to be received in circular openings 46 in the circuit board 8. The conductors 32 in the modular jack are arranged in side-by-side parallel relationship, each conductor having a contact portion 34 which extends into the opening 16 from the first internal sidewall at a location adjacent to the mating end 12. The conductors have contact portions 34 in the opening 16 and have downwardly extending lead portions 36 at the rearward end of the housing which are received in circuit board holes 44. The ends of these conductors would be soldered or otherwise connected to conductors on the circuit board.

The jack housing is provided with a clearance slot 40 which extends inwardly from the mating end in the lower portion of the housing. This clearance slot intersects the second opening sidewall 22 and the second opening external sidewall 28 so that only a portion of the floor of the opening on each side of the clearance slot or notch 40 remains.

The circuit board 8 has an upper surface 42 and has an edge 48 as previously noted which is proximate to the edges of the housing panels 4, 6, but which is recessed from one of these edges and from flanges 58, 52 on the panels 4, 6. The circuit board is also provided with the clearance notch 50 extending inwardly from the edge 48 which is in alignment with the clearance notch 40 when the modular jack is mounted on the circuit board.

Figure 2:
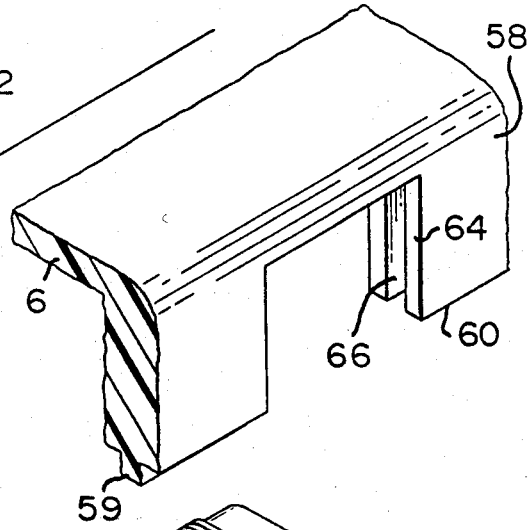
FIG. 2 is a view similar to FIG. 1 but showing the parts exploded from each other.
Figure 2:
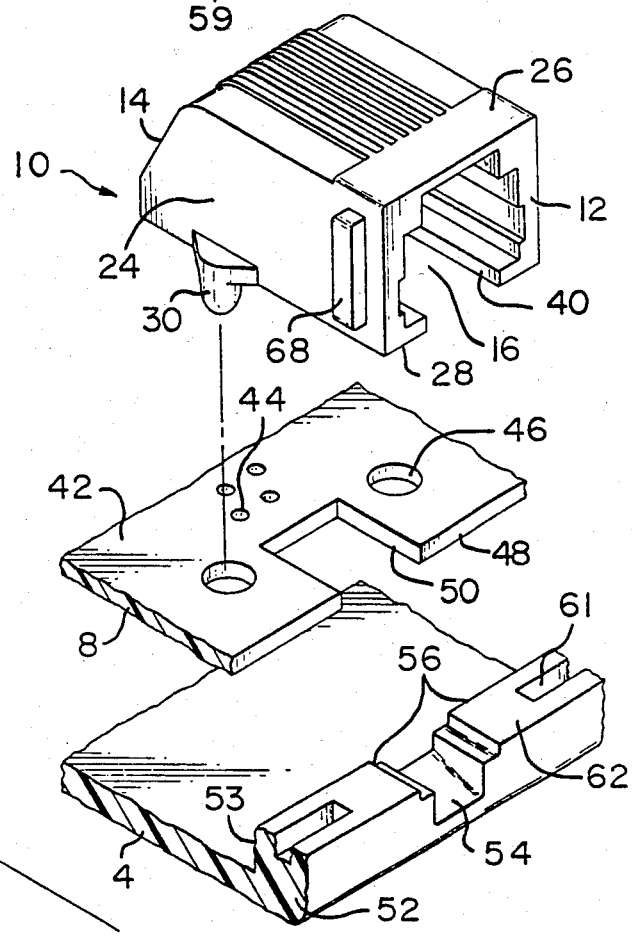

The lower panel 4 has upwardly extending flange or lip 52 and a recess 54 is provided in this lip which is centrally located with respect to the plug-receiving opening 16 of the modular jack and with respect to the clearance notches 40, 50. The recess 54 has a central portion which is inclined upwardly as viewed in FIG. 2 towards the internal surface 53 of the lip 52. It will be apparent that this recess 54 is of the same configuration as the recess in the mating end of a modular jack. This recess is dimensioned to receive a latch arm 76 of the modular plug 70 as described below and surface portions 56 of the internal surface 53 on each side of the recess function as latch shoulders for cooperation with the latching shoulders 78 of the latch arm 76 of the plug 70.

The second panel member 6 has a depending flange 58 having a lower edge 60 which is against the upper edge 62 of the lip 52 when the parts are assembled. Advantageously, inter-engaging ribs 59 and recesses 61 are provided on the flange and on the lip to locate the flange and lip accurately against each other.

Figure 3:
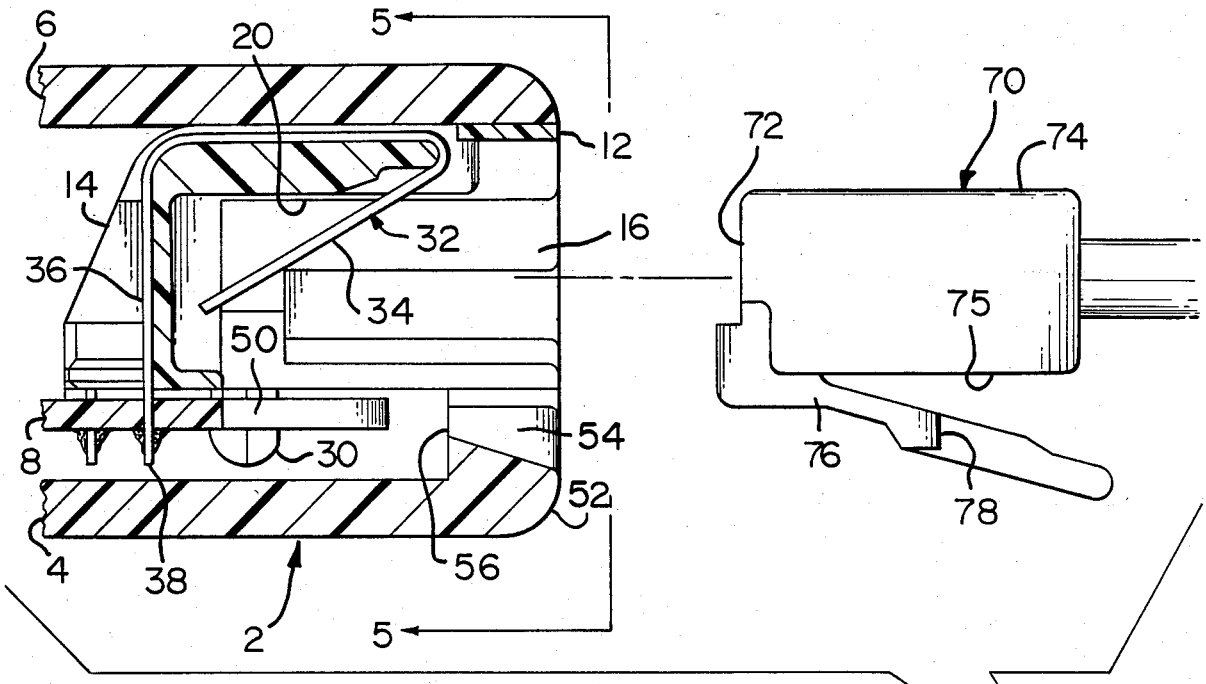
FIG. 3 is a sectional side view of the circuit board housing with a modular plug in alignement with the plug receiving opening of the modular jack.

The flange 58 has an opening 64 which is dimensioned to receive the mating end of the modular jack as shown in FIG. 3 so that the face of the jack will be flush with the surface of the flange 58. The flange 58 and the lip 52 form one wall of the circuit board housing which extends normally of the panels 4, 6.

The modular jack is precisely positioned with respect to the opening 64 by means of recesses 66 in the opposed edges of the opening 64 which receive ribs 68 extending from the endwalls 24 of the modular jack. In the completed assembly then, the opening 54 and the shoulders 56 will be precisely located relative to the modular jack housing.

The modular plug 70 is of the type described fully in U.S. Pat. No. 3,860,316. The plug comprises a housing having a leading end 72 and upper and lower surfaces 74, 75. The contact terminals in the plug are exposed at the upper surface 74 adjacent to the leading end 72 so that they will contact the contact portions 34 of the conductors in the jack.

The previously identified latch arm 76 extends from the plug housing adjacent to the leading end 72 and is beneath the lower surface 75 of the plug. The latch arm has shoulders 78 intermediate its ends which lodge against the shoulders 56 when the plug is inserted into the jack as shown in FIG. 4.

Figure 4:
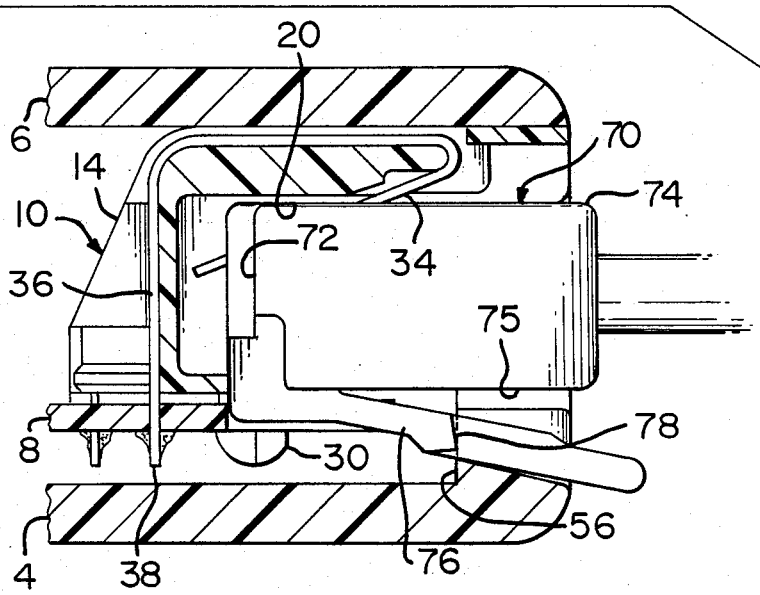
FIG. 4 is a view similar to FIG. 3 but showing the modular plug coupled to the modular jack.
Figure 5:
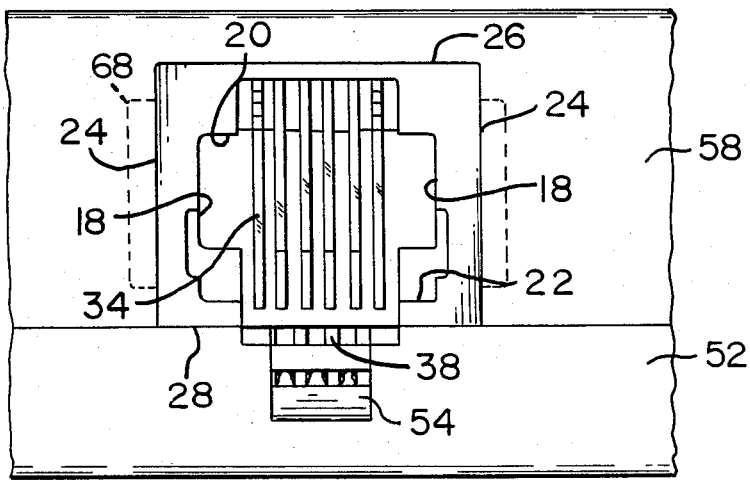
FIG. 5 is a frontal view of the modular jack.

When the plug is inserted as shown in FIG. 4, the lower portions of the plug housing are received in the aligned notches 40, 50 in the jack and in the circuit board. The housing is of substantially reduced height as viewed in FIG. 3 as compared with known types of housing and as a result, the overall thickness of the circuit board housing, as measured between the surfaces of the panels 4, 6, is substantially reduced. This reduction is achieved by virtue of the provision of the notches 40, 50 and the provision of the recess 54 in the lip 32 so that portions of this lip, in effect, function as parts of the modular jack.

I claim:

1. The combination of a modular jack receptacle mounted on one surface of a circuit board and a first panel which extends parallel to, and is spaced from, the other surface of the circuit board, the modular jack receptacle comprising an insulating housing having a mating end and a rearward end, a plug receiving opening extending into the mating end, the opening having opposed internal endwalls and first and second opening sidewalls, the housing having oppositely facing external endwalls and first and second external sidewalls which are proximate to the first and second opening sidewalls, a plurality of conductors in side-by-side relationship, each conductor having a contact portion which extends from the first opening sidewall diagonally into the opening from a location adjacent to the mating end and a lead portion which extends to the rearward end of the housing and to the one surface of the circuit board, the opening having latching shoulder means therein facing inwardly of the mating end for cooperation with a complementary latching shoulder on a modular plug, the combination of the modular jack receptacle, the circuit board, and the panel being characterized in that:

the circuit board has one edge which extends parallel to one edge of the first panel, the first panel having a lip extending from the one edge thereof towards the one edge of the circuit board, the lip having an internal surface which is parallel to and adjacent to the one edge of the circuit board, the modular jack being mounted on the circuit board adjacent to the one edge thereof and being oriented with the mating end extending normally of the plane of the circuit board and parallel to the lip of the first panel, the lip having a recess therein which is centrally located with respect to the plug-receiving opening, the lip constituting at least portions of the mating end of the modular jack, the latching shoulder means of the modular jack being on the internal surface of the lip adjacent to the recess in the lip.

2. The combination set forth in claim 1 characterized in that the circuit board has a circuit board notch extending inwardly from the one edge thereof, the circuit board notch being in alignment with the recess in the lip, and the modular jack has a clearance notch therein extending inwardly from the mating end, the clearance notch being in registry with the circuit board notch thereby to provide clearance for a modular plug upon insertion of the plug into the plugreceiving opening.

3. The combination set forth in claim 2 characterized in that the conductors in the modular jack are stamped and formed sheet metal conductors, the conductors extending across the rearward end of the modular jack and to circuit board conductors on the circuit board.

4. The combination set forth in claim 3 characterized in that a second panel extends parallel to the first panel, the second panel having an internal surface which is against the first external sidewall of the modular jack, the second panel having a flange extending towards the lip of the first panel, the flange having an opening therein, the mating end of the modular jack being in the opening.

5. The combination set forth in claim 4 characterized in that interengaging means are provided on the second panel and on the modular jack for maintaining the modular jack in position on the circuit board and in the opening in the flange.

6. The combination set forth in claim 5 characterized in that the interengaging means comprises ribs on the endwalls of the modular jack and rib-receiving recesses in the flange.

7. The combination set forth in claim 1 characterized in that a second panel extends parallel to the first panel, the second panel having an internal surface which is against the first external sidewall of the modular jack, the second panel having a flange extending towards the lip of the first panel, the flange having an opening therein, the mating end of the modular jack being in the opening.

* * * * *